US011629528B2

(12) United States Patent
Dirnberger et al.

(10) Patent No.: US 11,629,528 B2
(45) Date of Patent: Apr. 18, 2023

(54) DOOR LOCK FOR A DOMESTIC ELECTRICAL APPLIANCE WITH A MOVABLY ARRANGED LOCKING MEMBER

(71) Applicant: emz-Hanauer GmbH & Co. KGaA, Nabburg (DE)

(72) Inventors: Albert Dirnberger, Neunburg vorm Wald (DE); Markus Lang, Neunburg vorm Wald (DE); Georg Spiessl, Altendorf (DE); Robert Reitinger, Lappersdorf (DE)

(73) Assignee: EMZ-HANAUER GMBH & CO. KGAA, Nabburg (DE)

( * ) Notice: Subject to any disclaimer, the term of this patent is extended or adjusted under 35 U.S.C. 154(b) by 161 days.

(21) Appl. No.: 16/868,668

(22) Filed: May 7, 2020

(65) Prior Publication Data

US 2020/0354988 A1 Nov. 12, 2020

Related U.S. Application Data

(60) Provisional application No. 62/845,929, filed on May 10, 2019.

(51) Int. Cl.
*E05B 63/18* (2006.01)
*E05B 17/22* (2006.01)
(Continued)

(52) U.S. Cl.
CPC ..... *E05B 63/185* (2013.01); *E05B 9/02* (2013.01); *E05B 17/2007* (2013.01);
(Continued)

(58) Field of Classification Search
CPC ..... E05B 63/18; E05B 63/185; E05B 63/20; E05B 17/2007; E05B 17/2026;
(Continued)

(56) References Cited

U.S. PATENT DOCUMENTS 780,192 A 1/1905 Jones
2,772,106 A 11/1956 Semelka
(Continued)

FOREIGN PATENT DOCUMENTS

CN 101666028 A 3/2010
DE 3338604 A * 5/1985 ..... E05B 47/00
(Continued)

*Primary Examiner* — Christine M Mills
*Assistant Examiner* — Peter H Watson
(74) *Attorney, Agent, or Firm* — Hayes Soloway PC

(57) ABSTRACT

A door lock for a domestic electrical appliance comprises a movably arranged locking member, which is selectively adjustable into an unlocking position and a locking position and in the unlocking position permits the opening of a closed door of the domestic appliance and in the locking position is in blocking engagement with a blockable component, at least when the door is closed. The blocking engagement causes the closed door to be blocked against opening. The door lock further comprises an electrically controllable actuator for actuating the locking member, and an electrical door detection switch that switches depending on the closing of the door. The doer lock also comprises an electrical auxiliary switch device, which selectively opens or closes an electrical shunt path to the door detection switch depending on the position of the locking member.

11 Claims, 13 Drawing Sheets

Figure 1:
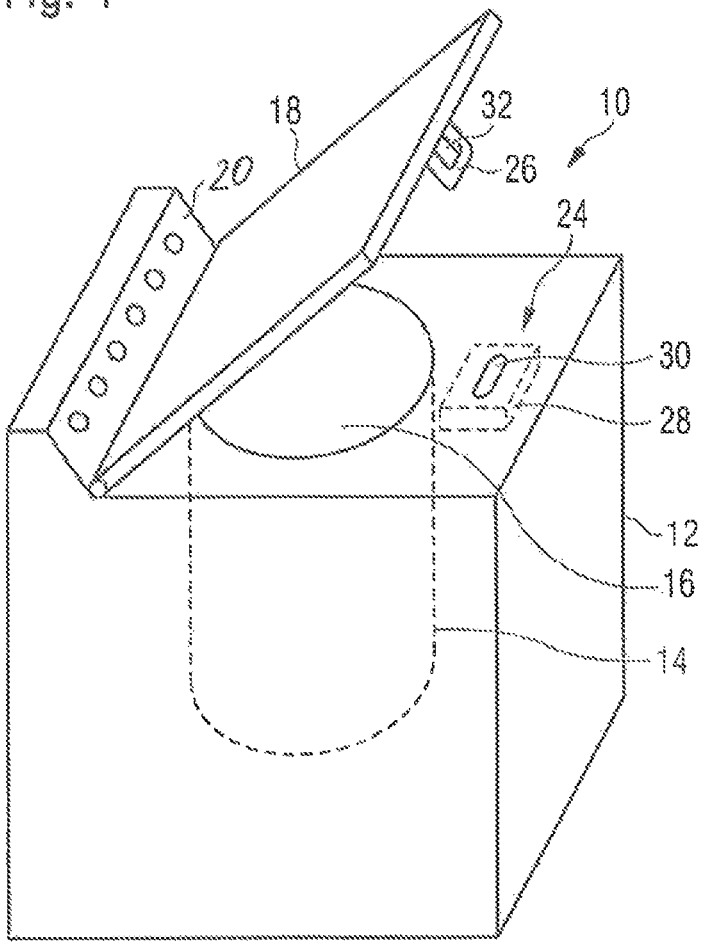

(51) Int. Cl.

| | |
|---|---|
| ***E05B 47/00*** | (2006.01) |
| ***E05B 47/06*** | (2006.01) |
| ***E05B 9/02*** | (2006.01) |
| ***E05B 17/20*** | (2006.01) |
| ***D06F 39/14*** | (2006.01) |
| ***D06F 58/20*** | (2006.01) |
| ***E05C 19/00*** | (2006.01) |
| ***E05B 63/00*** | (2006.01) |

(52) U.S. Cl.
CPC ..... *E05B 17/22* (2013.01); *E05B 47/0001* (2013.01); *E05B 47/0004* (2013.01); *E05B 47/0046* (2013.01); *E05B 47/0603* (2013.01); *E05B 63/0056* (2013.01); *E05C 19/009* (2013.01); *D06F 39/14* (2013.01); *D06F 58/20* (2013.01); *E05B 2047/0068* (2013.01); *E05B 2047/0069* (2013.01); *E05B 2047/0092* (2013.01); *E05Y 2900/312* (2013.01)

(58) Field of Classification Search
CPC .. E05B 17/2038; E05B 17/22; E05B 47/0001; E05B 47/0004; E05B 47/0603; E05B 2047/0081; E05B 2047/0068; E05B 2047/0069; E05C 19/009; D06F 39/14; D06F 37/42
USPC ..... 292/163, 144; 134/57 d, 57 dl
See application file for complete search history.

(56) References Cited

U.S. PATENT DOCUMENTS

| | | | | |
|---|---|---|---|---|
| 2,837,361 | A | 6/1958 | Loeb | |
| 2,857,191 | A | 10/1958 | Buchholtz | |
| 3,260,813 | A | 7/1966 | Dargene | |
| 3,765,194 | A | 10/1973 | Moore | |
| 4,351,288 | A | 9/1982 | Gasloli | |
| 4,718,705 | A * | 1/1988 | Case | D06F 37/42 292/201 |
| 4,907,831 | A | 3/1990 | Di Giusto | |
| 5,062,668 | A | 11/1991 | Onderka et al. | |
| 5,176,417 | A | 1/1993 | Bauer | |
| 5,419,305 | A | 5/1995 | Hanley | |
| 5,494,325 | A | 2/1996 | Liu et al. | |
| 5,997,056 | A | 12/1999 | Yamagishi | |
| 6,155,616 | A | 12/2000 | Akright | |
| 6,279,972 | B1 | 8/2001 | Brill et al. | |
| 6,290,270 | B1 | 9/2001 | Spiessl | |
| 6,390,518 | B1 | 5/2002 | Elick | |
| 6,739,633 | B2 | 5/2004 | Holloway et al. | |
| 6,913,296 | B2 | 7/2005 | Bassi | |
| 7,032,939 | B2 | 4/2006 | Magnusson | |
| 7,210,711 | B2 | 5/2007 | Dirnberger et al. | |
| 7,299,666 | B2 | 11/2007 | Geyer et al. | |
| 7,299,809 | B2 | 11/2007 | Kang | |
| 8,736,406 | B2 | 5/2014 | Hapke et al. | |
| 8,991,877 | B2 | 3/2015 | Spiessl | |
| 10,597,904 | B2 * | 3/2020 | Hintz | A47L 15/4259 |
| 2002/0056997 | A1 | 5/2002 | Bassi | |
| 2003/0160461 | A1 | 8/2003 | Promutico | |
| 2005/0194795 | A1 | 9/2005 | Hapke et al. | |
| 2006/0101869 | A1 | 5/2006 | Osvatic | |
| 2008/0042447 | A1 | 2/2008 | Neumann | |
| 2011/0057460 | A1 | 3/2011 | Onofrio | |
| 2016/0138809 | A1 | 5/2016 | Colucci et al. | |
| 2016/0251881 | A1 | 9/2016 | Dirnberger et al. | |
| 2018/0153370 | A1 * | 6/2018 | Lang | D06F 37/42 |
| 2021/0222459 | A1 * | 7/2021 | Promutico | D06F 37/42 |

FOREIGN PATENT DOCUMENTS

| | | | | |
|---|---|---|---|---|
| DE | 3426738 | A1 | 1/1986 | |
| DE | 3919458 | A1 | 12/1990 | |
| DE | 19601230 | A1 | 7/1997 | |
| DE | 19837248 | A1 | 2/2000 | |
| DE | 102004060607 | B3 | 3/2006 | |
| DE | 102007025295 | A1 | 12/2007 | |
| DE | 102006058322 | A1 * | 6/2008 | A47L 15/4259 |
| DE | 102006058322 | A1 | 6/2008 | |
| DE | 102006037494 | B4 | 7/2008 | |
| DE | 102007033451 | B4 | 9/2011 | |
| DE | 10 2010 051 518 | A1 | 5/2012 | |
| DE | 202015100627 | U1 | 6/2015 | |
| DE | 102015002538 | B3 | 3/2016 | |
| DE | 102016014481 | B3 * | 3/2018 | A47L 15/4259 |
| EP | 1344486 | A2 | 9/2003 | |
| EP | 1460163 | B1 | 1/2009 | |
| EP | 1 544 387 | B1 | 12/2010 | |
| EP | 2 367 997 | B1 | 5/2013 | |
| EP | 1 975 300 | B1 | 8/2015 | |
| JP | 2008-274741 | A | 11/2008 | |
| PL | 361358 | A | 10/2004 | |
| WO | 02/34994 | A1 | 5/2002 | |
| WO | 2006/063684 | A1 | 6/2006 | |
| WO | 2011109235 | A1 | 9/2011 | |
| WO | 2011132213 | A1 | 10/2011 | |
| WO | 2013109585 | A2 | 7/2013 | |
| WO | 2013/150410 | A1 | 10/2013 | |
| WO | WO-2014058714 | A2 * | 4/2014 | D06F 37/42 |
| WO | 2014113211 | A1 | 7/2014 | |
| WO | WO-2019147821 | A1 * | 8/2019 | D06F 39/14 |
| WO | WO-2020049603 | A1 * | 3/2020 | |

* cited by examiner 28
26
30
32
42
46
48
52
54
58
82
84
88
40
44
38
ST1
ST2
VEI
LS1
LS2
LS3
NP1
TEI
AK

DOOR LOCK FOR A DOMESTIC ELECTRICAL APPLIANCE WITH A MOVABLY ARRANGED LOCKING MEMBER

The present invention concerns a door lock for a domestic electrical appliance. Among other things, the present invention concerns measures for avoiding undesirable malfunctions in connection with an electrical door detection switch, which serves to detect whether a door of the domestic appliance is open or closed.

Conventional door locks for e.g. washing machines for domestic use are equipped with an electrical switch, which on closing a door of the domestic appliance carries out a change of electrical switching state, by means of which a control unit of the domestic appliance can detect whether the door is open or closed. Switches of this kind are described in the context of the present disclosure as door detection switches. In the case of conventional door locks, an electrically controlled actuator for actuating a locking member is only to be activated electrically if the door detection switch signals the closed state of the door. A prerequisite for activation of the actuator on conventional door locks is therefore a certain electrical switching state of the door detection switch. This is typically an electrically closed switching state. The closed door can be locked by operation of the locking member. In the locked state, it cannot be opened by a user without force.

It has been demonstrated that it cannot always be guaranteed that the door detection switch remains stably in a desired switching state, even if no event occurs that makes a change of switching state of the door detection switch desirable. It has thus been demonstrated, for example, that intentional or unintentional jerking movements on the door after it was closed and locked can occasionally lead to an at least temporary switchover of the door detection switch, although a switchover of the door detection switch is not at all desirable in such a situation. The door still remains closed and locked despite the vibration motions, which is why there is no necessity for a switchover of the door detection switch. An unclear, undefined state can therefore occur, in which, although the door is actually closed and locked, the door detection switch nevertheless signals an open door.

With regard to the prior art in respect of a door lock with a sensor for detecting the closed state of the door, reference can be made to WO 2018/236746 A1. A door lock is known from U.S. Pat. No. 7,150,480 B2 that explicitly aims to dispense with a door detection switch.

An object of the invention is to provide a door lock with high functional reliability for a domestic electrical appliance.

In achieving this object, the invention starts out from a door lock for a domestic electrical appliance comprising a movably arranged locking member selectively adjustable into an unlocking position and a locking position, which permits the opening of a closed door of the household appliance in the unlocking position and is in blocking engagement with a blockable component in the locking position, at least when the door is closed, wherein the blocking engagement causes the closed door to be blocked against opening; an electrically controllable actuator for actuating the locking member; and an electrical door detection switch that switches depending on the closing of the door. According to the invention, the door lock comprises an electrical auxiliary switch device, which selectively opens or closes an electrical shunt path to the door detection switch depending on the position of the locking member.

The invention can be used for different types of domestic appliances. These include washing machines, tumble dryers, so-called washer-dryers (i.e. appliances offering a combined washing and drying function for laundry), ovens, microwave ovens and similar. The concept of the door should be understood in broad terms in the context of the present disclosure; it comprises any cover elements suitable for covering an access opening through which a working space of the domestic appliance is accessible. The cover element is often attached pivotably to an appliance main body of the domestic appliance, but is not limited to a pivotable attachment. While such cover elements, which are located on the front of a domestic appliance, are often described as a door in everyday speech and cover elements of this kind located on the top of the domestic appliance are often described as a lid, the term door is to be understood in the context of the present disclosure as all-encompassing and is to comprise also said lids.

In the solution according to the invention, the door detection switch can be electrically short-circuited by the auxiliary switch device. Any undesirable changes of switching state of the door detection switch can thus remain devoid of any adverse effect on the function of the door lock with suitable control by the auxiliary switch device. By making the electrical switching state of the auxiliary switch device dependent on other circumstances/events than the electrical switching state of the door detection switch, circumstances/events that may lead to undesirable changes of switching state of the door detection switch can remain harmless for the overall electrical function of the door lock.

In certain embodiments, the auxiliary switch device closes an electrical shunt path to the door detection switch when the locking member moves from the unlocking position towards the locking position. If the door detection switch changes to an electrically closed switching state when the door is closed, the door detection switch remains electrically short-circuited by the auxiliary switch device following locking of the door (i.e. following transfer of the locking member to the locking position) even if, for example, the door detection switch temporarily opens due to vibration movements on the door. The electrical short circuit via the auxiliary switch device can guarantee that an electrical/electronic control unit of the domestic appliance does not receive any electrical signals that erroneously indicate an opening of the door when the door is closed and locked.

In certain embodiments, the locking member is arranged for movement from the unlocking position into the locking position and beyond the locking position into a fault position. Mobility of the locking member beyond the locking position can be useful in cases in which a user tries forcibly to open the closed and locked door. Part of the locking member may break off in this case. In certain embodiments the remaining, shortened piece of the locking member may then, after the user has forcibly opened the door, slide from the locking position further into the fault position under the influence of a spring bias force. Since a malfunction is now present, it can be sensible to interrupt the operation of the domestic appliance or prevent it from continuing. The auxiliary switch device can be designed for this purpose in such a way that it opens the shunt path again when the locking member moves from the locking position towards the fault position. Alternatively, the auxiliary switch device can be designed in such a way that it keeps the shunt path closed when the locking member moves from the locking position into the fault position.

In certain embodiments, the auxiliary switch device closes an electrical shunt path to the door detection switch when the locking member moves from the unlocking position towards an intermediate position opposite to the locking position. This intermediate position is a position which is initially approached by the locking member starting from the unlocking position and triggered by an actuation of the actuator, before the locking member, after reaching the intermediate position, moves in the opposite direction back to the unlocking position and beyond this into the locking position. Such a course of movement of the locking member can take place, for example, if the actuator is designed as an electromagnetic actuator, which is energised for a short time, i.e. in a pulsed manner, to transfer the locking member from the unlocking position to the locking position or vice versa. Due to the excitation pulse, a magnet armature of the actuator coupled to the locking member is pulled in a first direction. Following decay of the excitation pulse and a corresponding decrease in the magnetic force, the magnet armature moves under the influence of a spring bias force back in the opposite direction, wherein the locking member arrives in the respectively new position. The pulsed excitation of the actuator can lead to mechanical vibrations that may perhaps cause a temporary change of switching state of the door detection switch. In order to avoid unclear signal states hereby, it can be useful to short-circuit the door detection switch temporarily by means of the auxiliary switch device while the locking member moves from the unlocking position towards the intermediate position.

In certain embodiments the auxiliary switch device forms a single electrical shunt path to the door detection switch. In other embodiments, the auxiliary switch device forms at least two electrical shunt paths parallel to one another and to the door detection switch, which paths can be opened and closed individually by the auxiliary switch device. Thus in certain embodiments the auxiliary switch device closes a first electrical shunt path when the locking member moves from the unlocking position towards the locking position. When the locking member moves from the unlocking position towards an intermediate position opposite to the locking position, the auxiliary switch device closes a second electrical shunt path. The intermediate position is a position which is initially approached by the locking member starting from the unlocking position and triggered by an actuation of the actuator, before the locking member, after reaching the intermediate position, moves in the opposite direction back to the unlocking position and beyond this into the locking position.

In certain embodiments, the blockable component has a blocking edge which, on closing the door, moves past the locking member into and beyond a locking permit position, the locking permit position being a position from which the locking member can be moved in front of the blocking edge to thereby block the door against reverse movement. In these embodiments, the door detection switch, on closing the door, only changes its electrical switching state when the blocking edge has moved beyond the locking permit position. In these embodiments the door can therefore have a certain movement play relative to the locking member after it has been closed and locked. If the door is moved within this movement play, this can have the result that the door detection switch switches back and displays an open state of the door, although the door is actually closed and due to locking cannot be opened at all with out the use of force. This situation can occur in particular if the door detection switch is without switching hysteresis, thus changes its electrical switching state in both movement directions of the door in substantially the same door position. Due to its shunt function the auxiliary switch device can render such undesirable switching processes of the door detection switch harmless and inconsequential.

The door detection switch is a mechanically or magnetically actuatable switch, for example. A reed switch is an example of a magnetically actuatable switch.

In certain embodiments the auxiliary switch device is formed by a sliding lamella arrangement in sliding contact with a printed circuit board. The sliding lamella arrangement is movably coupled to the locking member, so that when the locking member moves, the sliding lamella arrangement also moves over the printed circuit board. Due to suitable configuration of conductor paths on the printed circuit board, the opening and closing of one or more shunt paths to the door detection switch can be realised while the sliding lamella arrangement moves over the printed circuit board.

According to another aspect of the invention, which does not require any auxiliary switch device of the type explained above, the blockable component can have a blocking edge which, on closing the door, moves past the locking member into and beyond a locking permit position, the locking permit position being a position from which the locking member can be moved in front of the blocking edge to thereby block the door against reverse movement. On closing the door, the door detection switch only changes its electrical switching state when the blocking edge has moved beyond the locking permit position into a first switching position. On opening the closed door, however, the door detection switch changes its electrical switching state in a second switching position of the blocking edge, which is offset from the first switching position towards the locking permit position. In this way a door detection switch can be created that has a suitable switching hysteresis, which prevents any movement play of the closed and locked door with respect to the locking member leading to undesirable switching processes of the door detection switch.

According to yet another aspect of the invention, which can be implemented alternatively or in addition to an auxiliary switch device of the type explained, the actuator can be designed as an electromagnetic actuator with a magnet armature that can be driven by magnetic excitation in a single drive direction only. In this aspect of the invention, the locking member is motion-coupled to the magnet armature and is biased by spring force against the drive direction. For position control of the locking member, a guide system is provided with a guide track closed in the manner of a loop and a track follower guided on the guide track. Upon successive actuations of the electromagnetic actuator, the track follower performs a complete round trip along the guide track, wherein on each round trip the track follower moves from a first non-transitory track position corresponding to the unlocking position of the locking member into a second non-transitory track position corresponding to the locking position of the locking member and back again into the first non-transitory track position. The locking member is arranged for movement from the unlocking position to the locking position and beyond the locking position into a fault position. The guide path provides an escape space, which allows the track follower to retreat from the second non-transitory track position into a third non-transitory track position corresponding to the fault position of the locking member.

In certain embodiments the door lock further comprises an electrical lock detection switch, which switches in dependence on a transfer of the locking member from the unlocking position into the locking position, in a first circuit path extending between a first and a second electrical connection point of the door lock. The actuator, the door detection switch and the auxiliary switch device are arranged by contrast in a second circuit path extending between the second electrical connection point and a third electrical connection point of the door lock. In embodiments of this kind the locking member is arranged for movement from the unlocking position into the locking position and beyond the locking position into a fault position, wherein the lock detection switch switches back into a switching state corresponding to the unlocking position depending on a transfer of the locking member from the locking position into the fault position. In the event of a fault such as can occur, for example, if a user tries to open the closed and locked door forcibly, the lock detection switch then returns to an electrical switching state corresponding to the unlocking position of the locking member. For a control unit of the domestic appliance, this is a signal to interrupt or prevent the operation of the domestic appliance, for example.

Another aspect of the invention that can again be implemented alternatively or in addition to an auxiliary switch device of the type explained provides an auxiliary member which is separate from the blockable component and is movable from a release position to a blocking position depending on the closing of the door and which, in the release position, allows the locking member to be transferred from the unlocking position to the locking position and, in the blocking position, blocks the locking member against transfer from the unlocking position to the locking position.

On closing the door, the door detection switch undergoes an electrical switching state change controlled mechanically by the auxiliary member.

In certain embodiments, an electrical household appliance equipped with a door lock of the type explained, which can be in the form of a washing machine, for example, comprises an appliance main body having an access opening to a working space within the appliance main body, a door mounted on the appliance main body for closing the access opening, and a door lock having a lock assembly and a blocking recess. The lock assembly is arranged on one of the appliance main body and door, while the blocking recess is arranged on the other of the appliance main body and door. The lock assembly comprises a movably arranged locking member selectively adjustable into an unlocking position and a locking position, which in the unlocking position permits the opening of the closed door and in the locking position is in blocking engagement with the blocking recess, at least when the door is closed, the blocking engagement causing blocking of the closed door against opening. The lock assembly further comprises an electrically controllable actuator for actuating the locking member and an electrical door detection switch, which switches depending on the closing of the door. According to the invention the domestic appliance is characterised by at least one of the following measures (a) to (d);

(a) the lock assembly comprises an electrical auxiliary switch device which selectively opens or closes an electrical shunt path to the door detection switch depending on the position of the locking member;

(b) the blocking recess is delimited by a blocking edge which, on closing the door, moves past the locking member into and beyond a locking permit position, the locking permit position being a position from which the locking member can be moved in front of the blocking edge and into the blocking recess and thereby blocks the door against reverse movement, wherein the door detection switch, on closing the door, changes its electrical switching state only after the blocking edge has moved beyond the locking permit position to a first switching position, and wherein the door detection switch, on opening the closed door, changes its electrical switching state to a second switching position of the blocking edge which is offset from the first switching position towards the locking permit position;

(c) the actuator is designed as an electromagnetic actuator comprising a magnet armature that can be driven by magnetic excitation in a single drive direction only, wherein the locking member is motion-coupled to the magnet armature and is biased by spring force against the drive direction, wherein the locking member is associated with a guide system for position control of said member having a guide track closed in the manner of a loop and a track follower guided on the guide track, wherein the track follower performs a complete round trip along the guide track upon successive actuations of the electromagnetic actuator, wherein on each round trip the track follower moves from a first non-transitory track position corresponding to the unlocking position of the locking member into a second non-transitory track position corresponding to the locking position of the locking member and back again into the first non-transitory track position, wherein the locking member is arranged for movement from the unlocking position to the locking position and beyond the locking position into a fault position and wherein the guide path provides an escape space which allows the track follower to retreat from the second non-transitory track position to a third non-transitory track position corresponding to the fault position of the locking member;

(d) the lock assembly comprises an auxiliary member which is separate from the blockable component and can be moved from a release position to a blocking position depending on the dosing of the door, and which, in the release position, allows the locking member to be transferred from the unlocking position to the locking position and, in the blocking position, blocks the locking member against transfer from the unlocking position to the locking position, wherein, on closing the door, the door detection switch undergoes an electrical switching state change under mechanical control by the auxiliary member.

Figure 2:
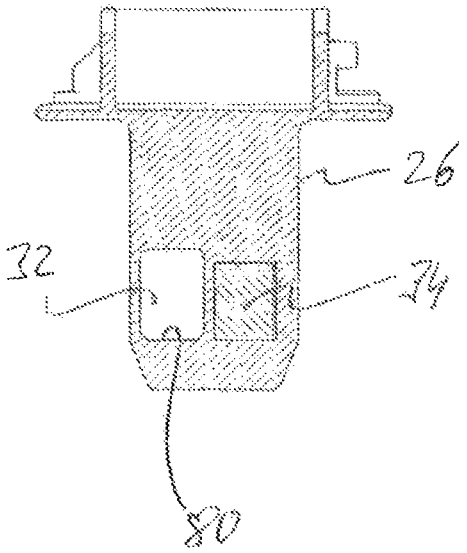
Figure 3A:
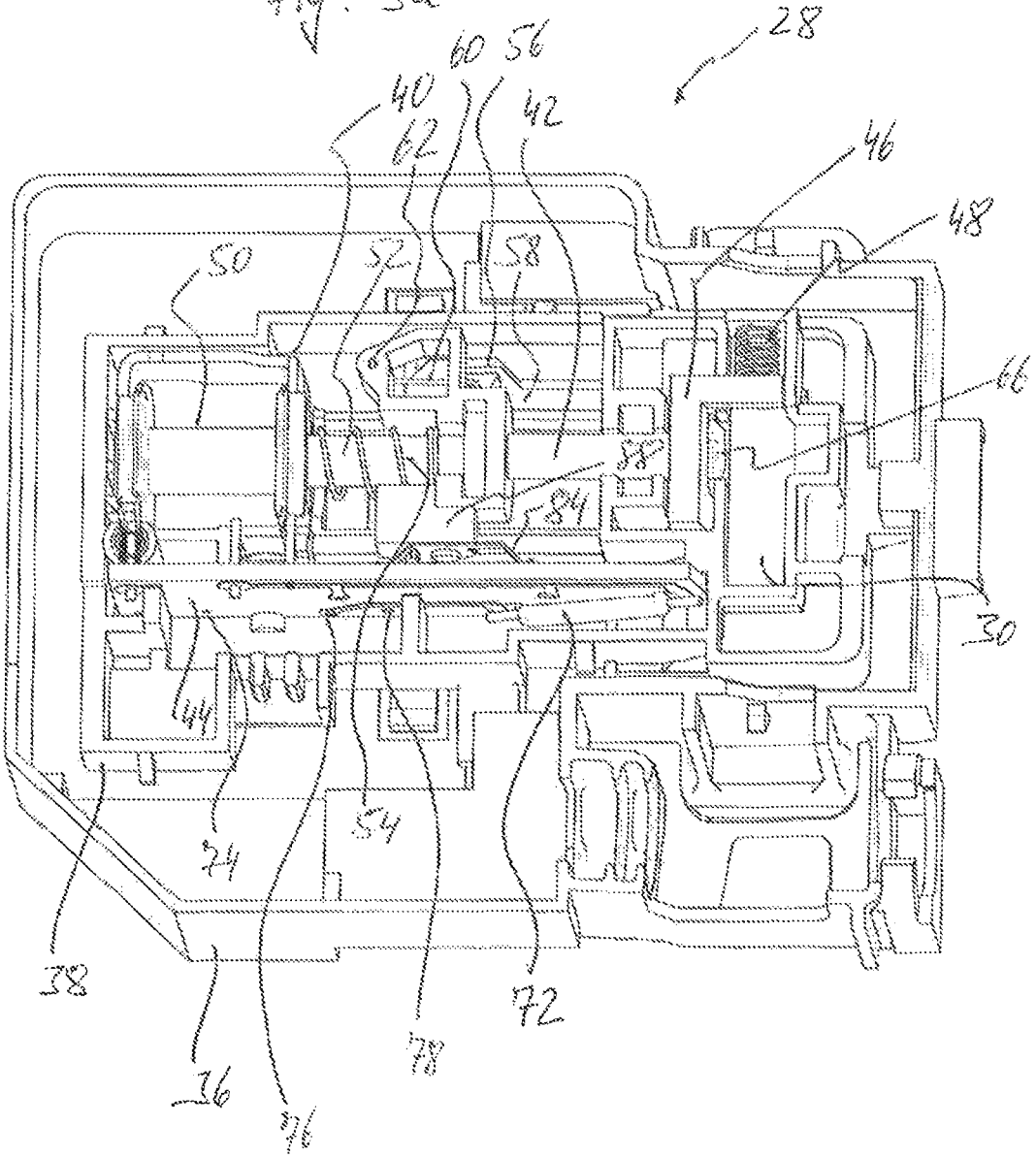
Figure 3C:
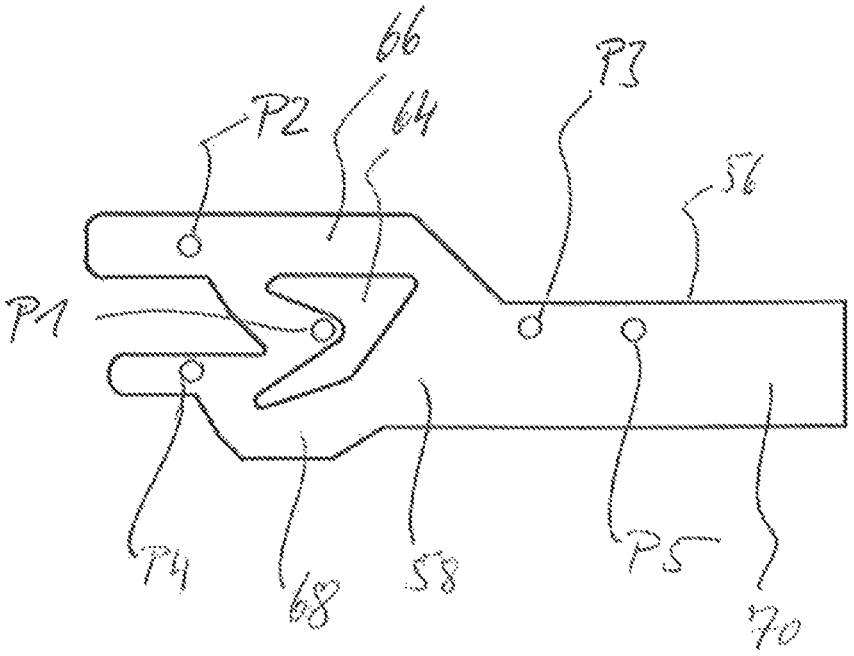
Figure 4:
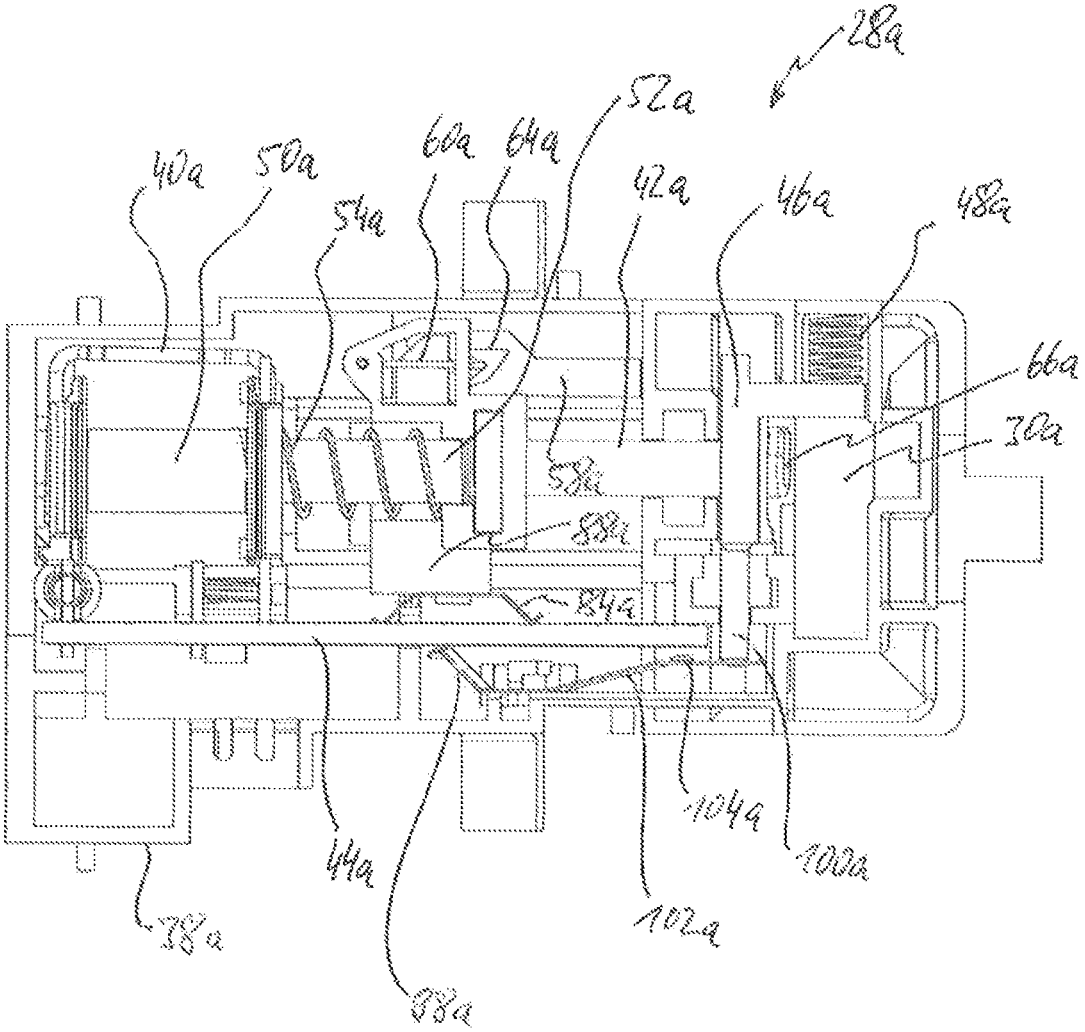
Figure 8A:
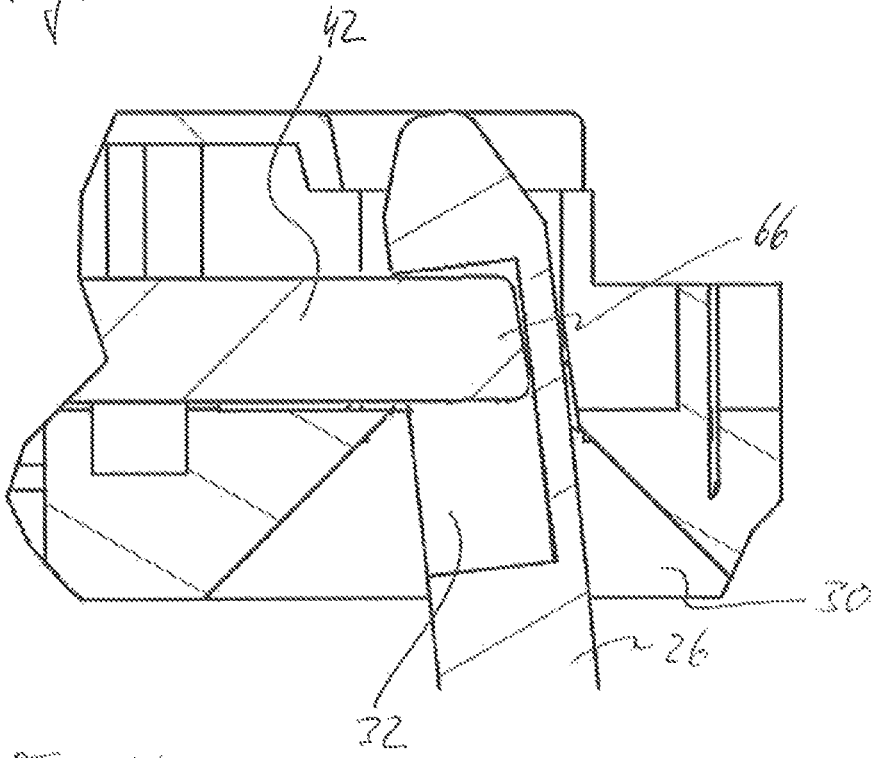
Figure 8B:
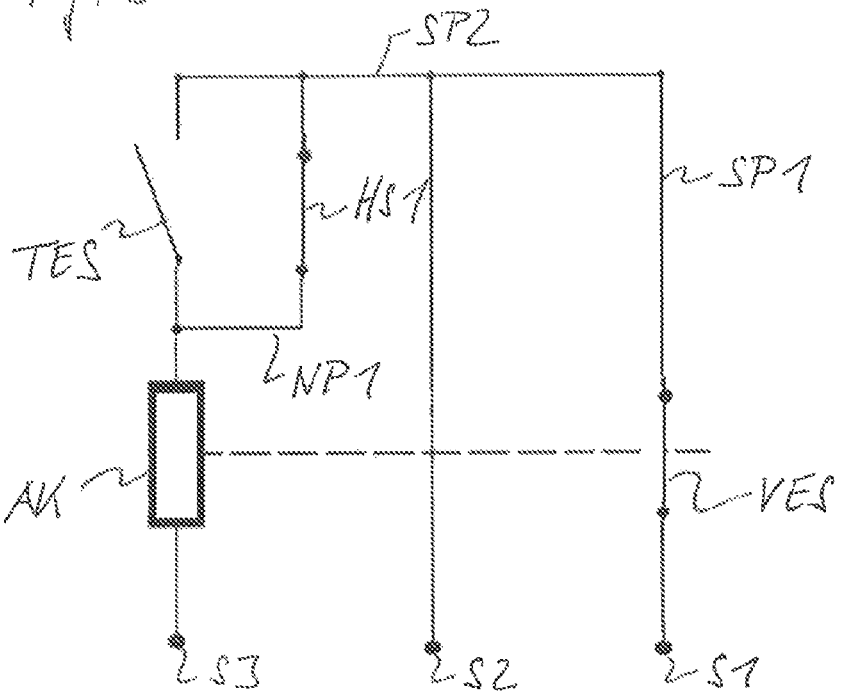
Figures 9A, 9B, 9C:
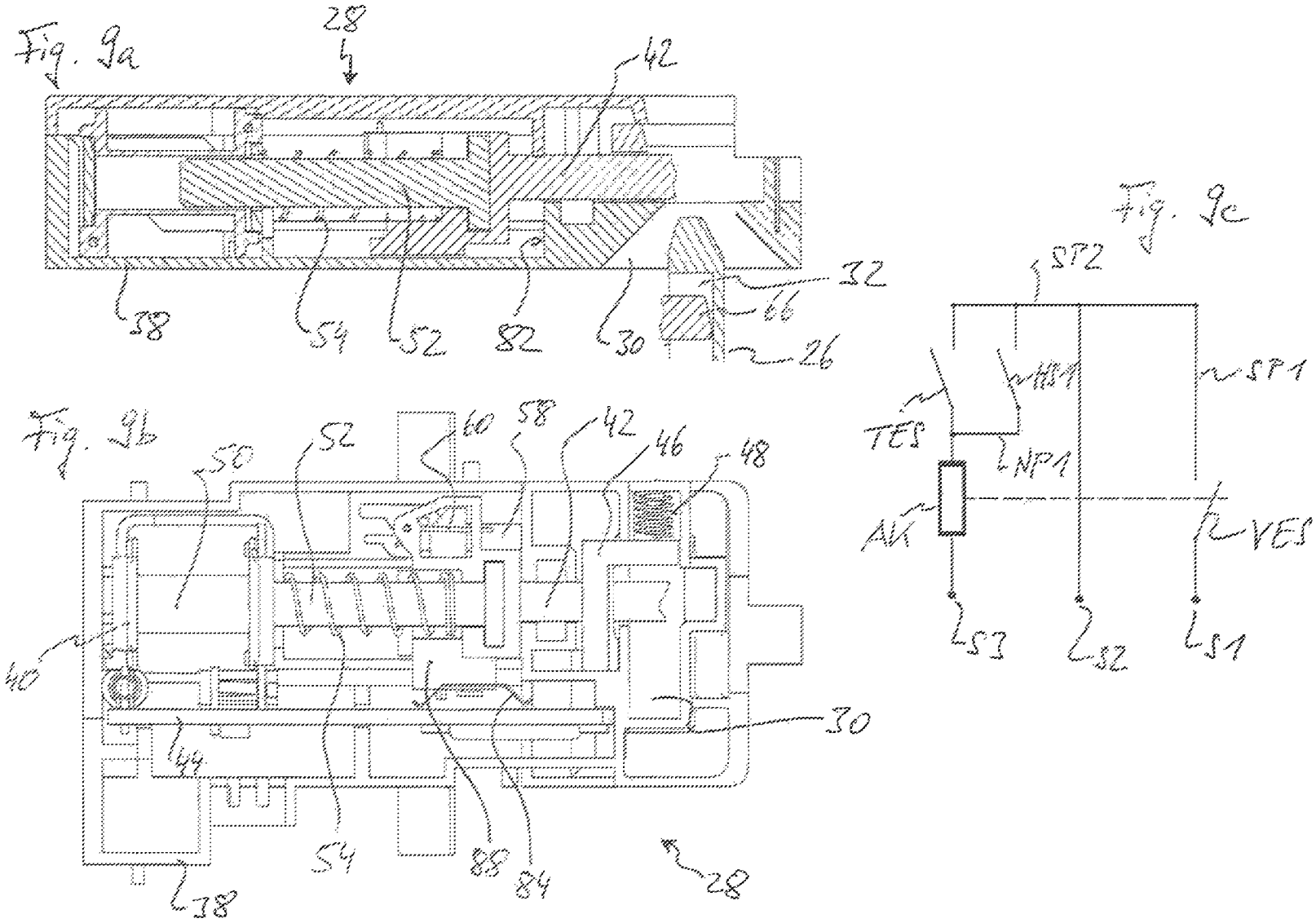
Figure 10:
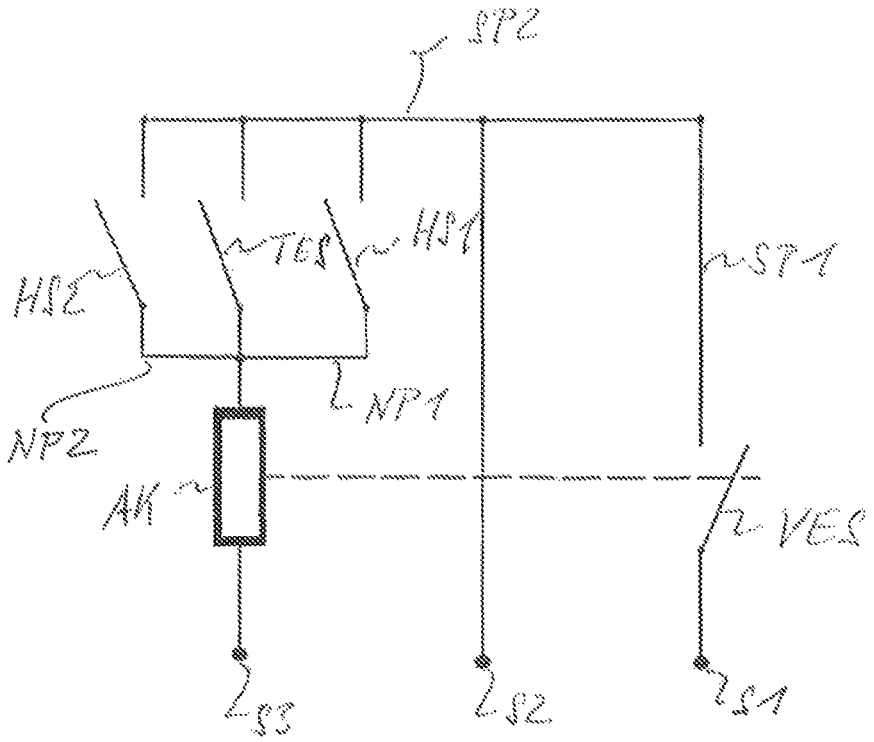

The invention is explained further below based on the enclosed drawings. These depict:

FIG. 1, a schematic perspective view of a household washing machine according to an exemplary embodiment, FIG. 2, a section through a closing element according to an exemplary embodiment, FIG. 3*a*, a lock assembly of a door lock in an unlocked state according to an exemplary embodiment, FIG. 3*b*, the lock assembly of FIG. 3*a* in a locked state, FIG. 3*c*, a guide link for position control of a locking slide of the lock assembly of FIGS. 3*a*, 3*b* according to an exemplary embodiment, FIG. 4, a lock assembly with a mechanically actuated door detection switch according to an exemplary embodiment, FIGS. 5*a*, 6*a*, 7*a*, 8*a*, 9*a* and 9*b*, various operating situations of the door lock with the lock assembly in FIGS. 3*a*, 3*b*, FIGS. 5*b*, 6*b*, 7*b*, 8*b* and 9*c*, electrical circuit diagrams of the lock assembly for the operating situations shown in FIGS. 5*a*, 6*a*, 7*a*, 8*a* and 9*b*, FIG. 10, an electrical circuit diagram of a lock assembly according to another exemplary embodiment, FIGS. 11*a* to 11*d*, a printed circuit board with a sliding lamella metal sheet sliding thereon to realise the electrical circuit diagram of FIG. 10.

Reference is made first to FIGS. 1 and 2. The household washing machine shown in FIG. 1 and generally designated 10 is of the top loader type in the example shown and comprises a machine main body 12 (which can also be described as appliance main body or carcass), in which a suds container 14, indicated by dashed lines, is accommodated. Supported in a known manner rotating in the suds container 14 is a washing drum (not shown), which forms a working space (laundry space) of the washing machine 10. This laundry space is accessible through an access opening 16 formed on the top side of the machine main body 12. A lid 18 held pivotably about a horizontal pivot axis on the machine main body 12 can be pivoted upwards to release the access opening 16 and enable a user to insert and remove laundry, and can be folded down, so that the lid 18 rests horizontally on the machine main body 12 and blocks the access opening 16. On a control panel 20 various operating elements and display elements are present, which act as a control interface between the washing machine and the user and permit the user to set various wash programs, for example.

The lid 18 forms a door in the context of the present disclosure. It is understood that the invention is not restricted to washing machines of the top loader type; rather it can also be used on household washing machines of the front loader type, which usually have a porthole door pivotable about a vertical pivot axis. In the following the lid 18 will nonetheless continue to be termed a lid (and not a door).

To keep the lid 18 closed, i.e., when it is folded down onto the machine main body 12, a door lock generally designated 24 is used, which comprises a closing element 26 and a lock assembly 28 as two basic components. The closing element 26 and the lock assembly 28 interact on closing the lid 18 in that the closing element 26 enters an insertion mouth 30 of the lock assembly 28 and can be secured against withdrawal from the insertion mouth 30 by the lock assembly 28 in a manner explained in greater detail below. In the example shown, the closing element 26 is mounted on the lid 18, whereas the lock assembly 28 is mounted on the machine main body 12. It is understood that the arrangement pattern of the closing element 26 and the lock assembly 28 can be interchanged, i.e., the closing element 26 can be mounted on the machine main body 12 and the lock assembly 28 can be mounted on the lid 18.

The closing element 26 has a blocking recess 32, into which a locking slide (not shown separately in FIGS. 1 and 2) contained in the lock assembly 28 can enter for the purpose of locking the lid 18. As long as the locking slide does not engage in the blocking recess 32 of the closing element 26, the lid 18 can be reopened at any time by the user. The start of a wash program, in particular the inlet of water into the suds container 14, is only possible in the washing machine 10 after the locking slide has entered the blocking recess 32 of the closing element 26 and the lid 18 is locked accordingly. In this state the lid 18 cannot be opened by the user without the use of force. The blocking recess 32 does not extend completely through the closing element 26; rather it passes only through a portion of the thickness of the closing element 26. The blocking recess 32 therefore only forms a depression in the closing element 26.

In the exemplary embodiment shown in FIG. 2, the closing element 26 is equipped with a permanent magnet 34, which is used to magnetically actuate a reed switch of the lock assembly 28 that serves as a door detection switch and is explained further below. The permanent magnet 34 can be dispensed with if a mechanically actuated door detection switch is used instead of a magnetically actuated door detection switch. An exemplary embodiment with such a mechanically actuatable door detection switch is explained further below in connection with FIG. 4. First, however, the exemplary embodiment in FIGS. 3*a*, 3*b* is explained, in which a magnetically actuatable door detection switch in the form of a reed switch is present.

The lock assembly 28 according to the exemplary embodiment in FIGS. 3*a*, 3*b* comprises an external housing 36, in which an internal housing is taken up in a floating manner. For details of the floating support of the internal housing 38 in the external housing 36, reference is made to German patent application No. 10 2019 008 338.5, the contents of which are hereby incorporated in full by explicit reference. Instead of an external housing and an internal housing taken up therein in a floating manner, the lock assembly 28 can alternatively have a lock housing without floating housing parts. The accommodation of certain individual components of the lock assembly 28 in the floating internal housing 38 forms just one example without any restrictive implication.

In the example shown, an electromagnetic actuator 40, said locking slide, designated 42, a printed circuit board 44 and an auxiliary slide 46 are taken up in the internal housing 38. The locking slide 42 is movable linearly between an unlocking position shown in FIG. 3*a* and a locking position shown in FIG. 3*b*. Through consecutive, pulsed activations of the electromagnetic actuator 40, the locking slide 42 can be switched alternately between the unlocking position and the locking position. In the unlocking position, the locking slide 42 is blocked by the auxiliary slide 46 against transfer to the locking position, at least as long as the closing element 26 has not entered the insertion mouth 30. The auxiliary slide 46 can be displaced transversely to the locking slide 42, to be precise against the force of a bias spring 48. When the lid 18 is closed, the closing element 26 butts against the auxiliary slide 46 and pushes this aside (FIG. 3*a*, top). Blocking of the locking slide 42 is lifted thereby. The locking slide 42 can now be transferred to its locking position by activation of the electromagnetic actuator 40. Details of the interaction of locking slide 42 and auxiliary slide 46 can be found in German patent application No. 10 2019 005 564.0, the contents of which are incorporated in full hereby by explicit reference.

The electromagnetic actuator 40 comprises a magnetic coil 50 and a magnet armature 52, which can be moved deeper into the magnetic coil 50 against the force of an armature spring 54 (to the left in the depiction in FIGS. 3*a*, 3*b*) by excitation of the magnetic coil 50. The magnet armature 52 is coupled to the locking slide 42 (by positive form locking in the example shown) so that a movement of the magnet armature 52 is accompanied by a movement of the locking slide 42 in the same direction. A guide link 56 is formed for position control of the locking slide 42 on the internal housing 38, which guide link forms a guide track 58 for a track follower 60 coupled to the locking slide 42. The track follower 60 is formed by a piece of wire, for example, the opposing ends of which are bent, wherein one end of the piece of wire engages in the guide link 56 and the other end is inserted into a hole 62 of the locking slide 42, so that the piece of wire as a whole can move with the locking slide 42, but is swivellable relative to the locking slide 42.

An exemplary configuration of the guide link 56 is shown in FIG. 3*c*. The guide link 56 has a central guide island 64, around which the guide track 58 extends in the manner of an endless loop. Various positions of the track follower 60 along the guide track 58 are drawn in on FIG. 3*c*. In a position P1 the track follower 60 is supported on the guide island 64. This is a first non-transitory track position of the track follower 60. Position P1 is non-transitory because the track follower 60 is pressed against the guide island 64 by the spring force of the armature spring 54. Without excitation of the magnetic coil 50 the track follower 60 cannot move out of the position P1 and accordingly remains in position P1 until a next excitation of the magnetic coil 50 takes place. The position P1 of the track follower 60 corresponds to the unlocking position of the locking slide 42 according to FIG. 3*a*.

After the lid 18 has been closed and the closing element 26 has entered the insertion mouth 30 of the lock assembly 28, the track follower 60 moves initially upon excitation of the magnetic coil 50, stating from the position P1, to a transitory intermediate position P2. This corresponds to a movement of the magnet armature 52 deeper into the magnetic coil 50. The armature spring 54 is biased more strongly in this movement. As soon as the excitation of the magnetic coil 50 decays, the armature spring 54 pushes the magnet armature 52 back in the opposite direction. The track follower 60 moves here out of position P2 into a second non-transitory position P3, passing the central guide island 64 in an upper track branch 66. In position P3 a free (front) slide end 66 (FIG. 3*a*) of the locking slide 42 enters the blocking recess 32 of the closing element 26. Because the blocking recess 32 does not pass completely through the closing element 26, the front slide end 66 of the locking slide 42 butts on the bottom of the blocking recess 32 and stops there. Position P3 of the track follower 60 consequently corresponds to the locking position of the locking slide 42 according to FIG. 3*b*. On account of the abutting of the locking slide 42 on the closing element 26 (more precisely on the bottom of the blocking recess 32) and the stoppage of the locking slide 42 enforced thereby, position P3 is a non-transitory track position. The track follower 60 remains in position P3 until the magnetic coil 50 is excited afresh.

If the magnetic coil 50 is excited afresh starting out from the locking position according to FIG. 3*b*, the track follower 60 migrates from position P3 initially to a transitory intermediate position P4. In doing so it passes the central guide island 64 in a lower track branch 68. As soon as the excitation of the magnetic coil 50 decays, the armature spring 54 pushes the magnet armature 52 in the opposite direction again, whereby the track follower 60 moves from the intermediate position P4 into position P1, in which the track follower 60 rests stably on the guide island 64 again. The track follower 60 has now performed a complete round trip around the guide island 64.

In FIG. 3*c* a position P5 is additionally drawn in, which is located beyond position P3 when seen from position P1, thus even further away from position P1 than position P3. Position P5 corresponds to a fault position of the locking slide 42, which is explained in detail below. It lies in a track extension 70 of guide track 58, thereby creating an escape space that permits the track follower 60 to escape from position P3 to position P5 if the fault that is yet to be explained occurs.

The design and function of an electrical circuit of the lock assembly 28 is now explained on the basis of FIGS. 5*a* to 9*b*. According to FIG. 5*b*, the electrical circuit of the lock assembly 28 has three electrical connection points S1, S2 and S3. The connection points S1, S2, S3 can be formed by plug-in connection points at which an external plug connector to the lock assembly 28 can be plugged in to connect the internal circuit of the lock assembly 28 electrically to an external circuit of the washing machine 10. The connection points S1, S2, S3 can alternatively be formed as wire connection points, which are each provided for connection to a connection wire. In the design as wire connection points in particular, the connection points S1, S2, S3 can be provided directly on the printed circuit board 44 of the lock assembly 28, for example in the form of holes in the printed circuit board 44, into which the wires are inserted and can be permanently soldered there. In the example of FIGS. 3*a*, 3*b* the connection points S1, S2, S3 are formed at holes 74, 76, 78 in the printed circuit board 44.

The connection points S1, S2 are connected to one another via a first electrical circuit path SP1. A lock detection switch VES is arranged in the circuit path SP1. The lock detection switch VES is used to detect the locked state of the lid 18. Upon transfer of the locking slide 42 from the unlocking position according to FIG. 3*a* into the locking position according to FIG. 3*b*, the lock detection switch VES performs a change from an electrically open switching state to an electrically closed switching state. In the electrically closed switching state the circuit path SP1 is closed; an electric current can flow between the interface connections S1, S2.

A second electrical circuit path SP2 runs between the connection points S2, S3. The two circuit paths SP1, SP2 therefore have connection point S2 as a common connection point. An electrically controllable actuator AK, formed by the electromagnetic actuator 40, for actuating the locking slide 42 is contained in the circuit path SP2. Arranged electrically in series to the actuator AK in the circuit path SP2 is a parallel circuit of several electrical switches. These switches comprise a door detection switch TES and a first auxiliary switch HS1.

The door detection switch TES serves to detect the closed state of the lid 18 of the washing machine 10. In the exemplary embodiment in FIGS. 3*a*, 3*b* it is formed by a reed switch 72 mounted on the printed circuit board 44, which switch interacts on closing of the lid 18 with the permanent magnet 34 of the closing element 26 and switches from an electrically open switching state to an electrically closed switching state when the closing element 26 has entered sufficiently far into the insertion mouth 30 of the lock assembly 28. The electrically closed switching state is an indicator for a control unit of the washing machine 10, which unit is not depicted in greater detail in the figures, that the lid 18 is closed. If the control unit detects that the lid 18 has been closed, it energises the actuator AK (electromagnetic actuator 40), whereby the locking slide 42 is moved into its locking position according to FIG. 3*b*. As a result the lock detection switch VES closes, wherefrom the control unit detects that the lid 18 is now locked. The locked state of the lid 18 is a prerequisite for the control unit to start a program cycle of the washing machine 10 and to set the washing drum in motion.

The first auxiliary switch HS1 is arranged in an electrical shunt path NP1 to the door detection switch TES. The door detection switch TES can be short-circuited by closing the auxiliary switch HS1. The closed state of the auxiliary switch HS1 depends on the position of the locking slide 42. Specifically, the auxiliary switch HS1 is in an electrically open switching state when the locking slide 42 is located in its unlocking position. If the locking slide 42 is moved from the unlocking position to the locking position, the auxiliary switch HS1 closes, which closes the shunt path NP1. If it happens that the door detection switch TES opens for any reason when the lid 18 is locked, this has no influence on the control unit of the washing machine 10. Because the shunt path NP1 is closed, a flow of electric current is still possible between the connection points S2, S3 even if the door detection switch TES is open. This function of the auxiliary switch HS1 is useful, because in the exemplary embodiment explained here, the lid 18 has a certain movement play in the opening direction in the locked state and this movement play can lead to opening of the door detection switch TES. Since the movement play changes nothing in the locked state of the lid 18, the temporary opening of the door detection switch TES should have no influence on the operation of the washing machine 10. This is guaranteed by the auxiliary slide of HS1, which snort-circuits the door detection switch TES in the locking position of the locking slide 42.

Figure 5A:
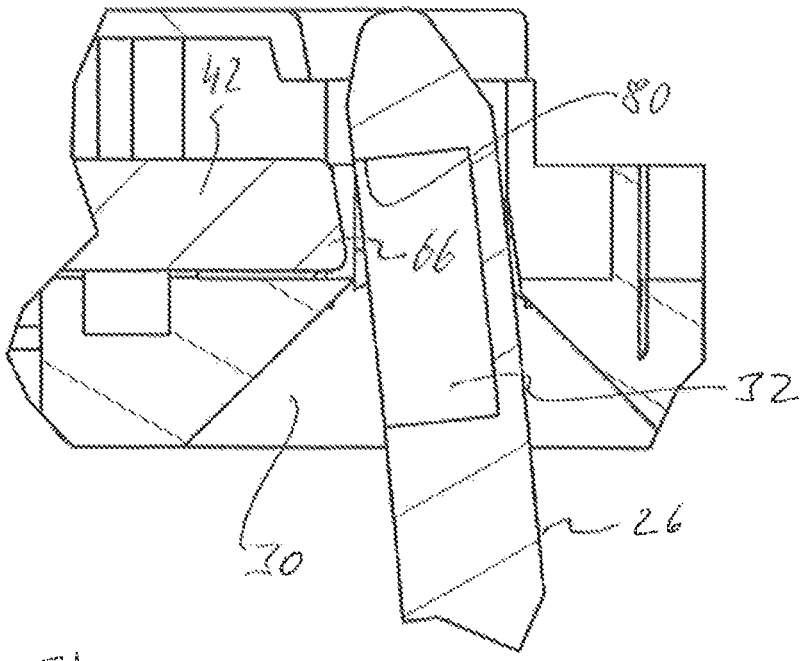
Figure 5B:
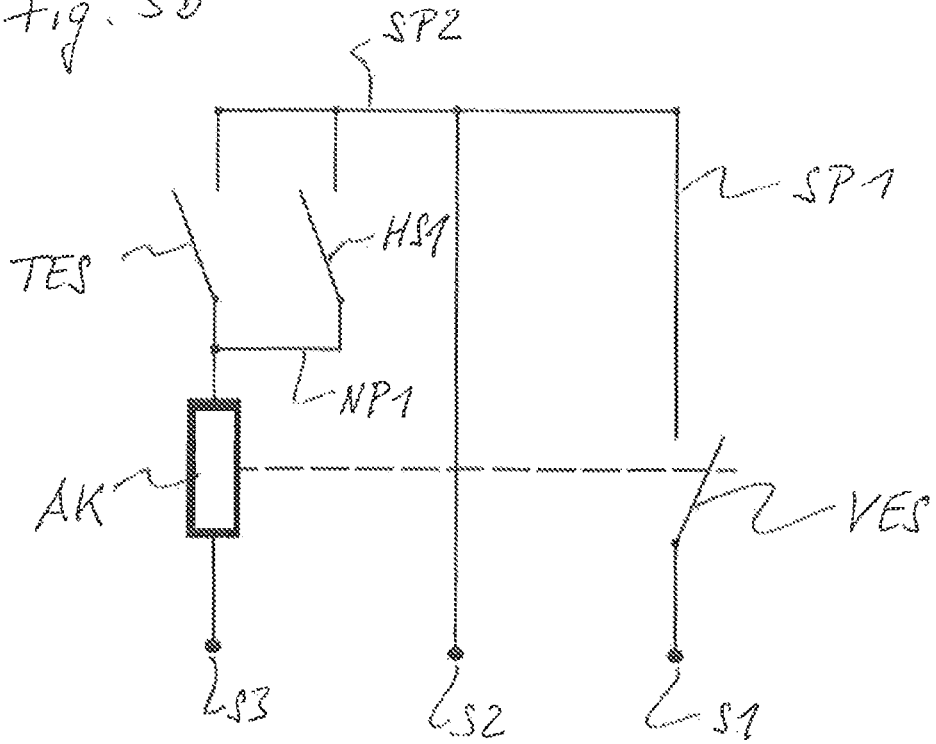

For a more detailed explanation of this movement play, reference is made first to FIG. 5*a*. In the situation shown there, the closing element 26 has entered the insertion mouth 30 of the lock assembly 28 until the front boundary edge of the blocking recess 32, which is designated 80 and is the leading edge on closure of the lid 18, has just moved past the locking slide 42 and the locking slide 42 can now enter the blocking recess 32 for the first time. This insertion position of the closing element 26 can be described as the locking permit position. In the locking permit position, the fundamental possibility exists for the first time of moving the locking slide 42 forwards from the unlocking position into the locking position. Before the closing element 26 reaches the locking permit position according to FIG. 5*a* (i.e. as long as the boundary edge 80, which can also be described as the blocking edge, is still located in front of the locking slide 42), the locking slide 42 cannot be moved forwards. It is only in the locking permit position according to FIG. 5*a* that movement of the locking slide 42 forwards into its locking position is possible in principle and is no longer blocked by the boundary edge 80.

Figure 6A:
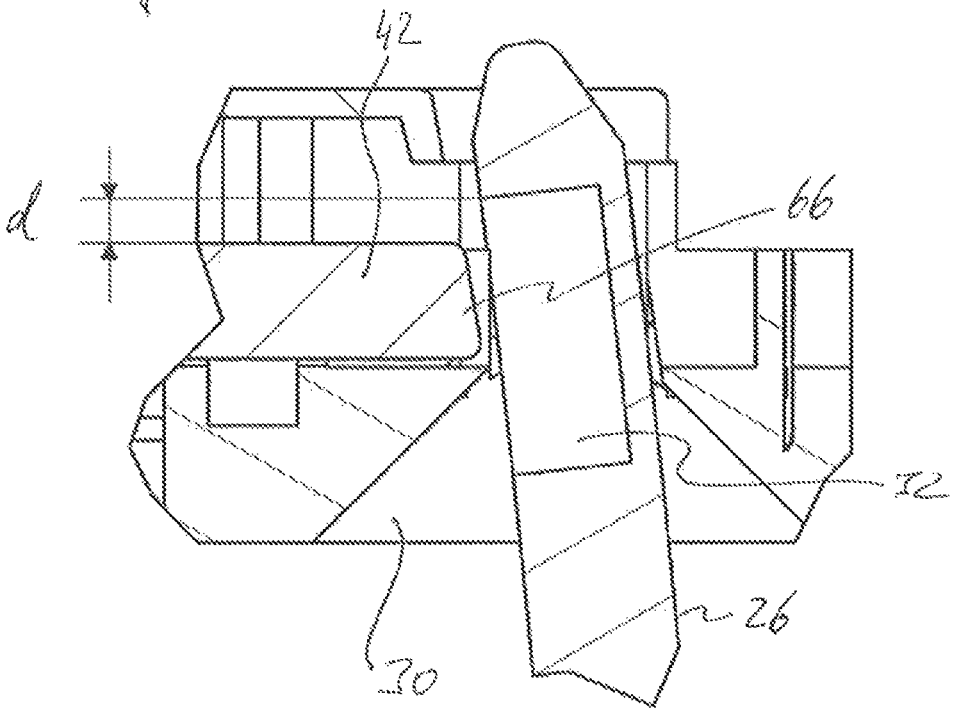

In practice, however, in quite a number of appliances in a large-scale production series of appliances, the door detection switch TES will not close exactly at the moment at which the closing element 26 reaches its locking permit position. Instead the washing machine 10 will be nominally designed so that the door detection switch TES only closes after the closing element 26 has gone beyond the locking permit position somewhat deeper into the insertion mouth 30. This situation is depicted in FIG. 6*a*. Here the closing element 26 has moved by an extent d beyond the locking permit position into the insertion mouth 30. This position of the closing element 26 can be described as the switch closing position. The washing machine 10 is nominally designed so that on closing of the lid 18, the door detection switch TES only closes upon reaching the switch closing position of the closing element 26. In a large-scale production series of washing machines 10, however, the value of the measurement d will not be identical for all machines in the series due to unavoidable component and fitting tolerances. It will instead be smaller on some machines and larger on others. A suitably set nominal value of the measurement d creates the necessary play to guarantee on all machines of the production series, despite such unavoidable tolerances, that upon closing of the lid 18 the door detection switch TES does not close under any circumstances before the closing element 26 reaches the locking permit position.

Figure 6B:
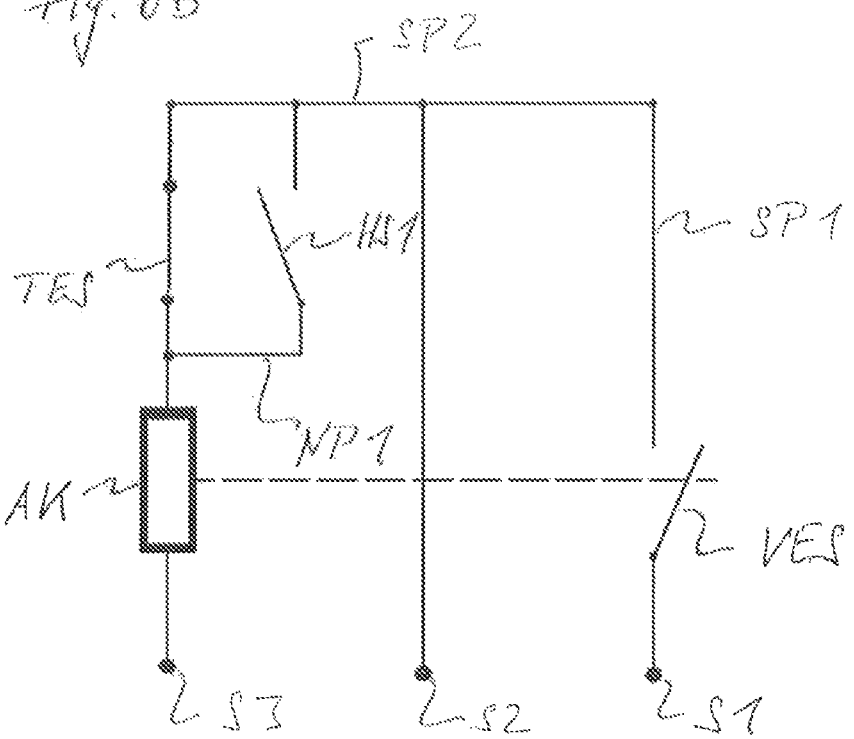

As shown in FIG. 6*b*, after reaching the switch dosing position on closing of the lid 18, the door detection switch TES is closed. The auxiliary switch HS1 and the lock detection switch VES 1 remain open.

Figure 7B:
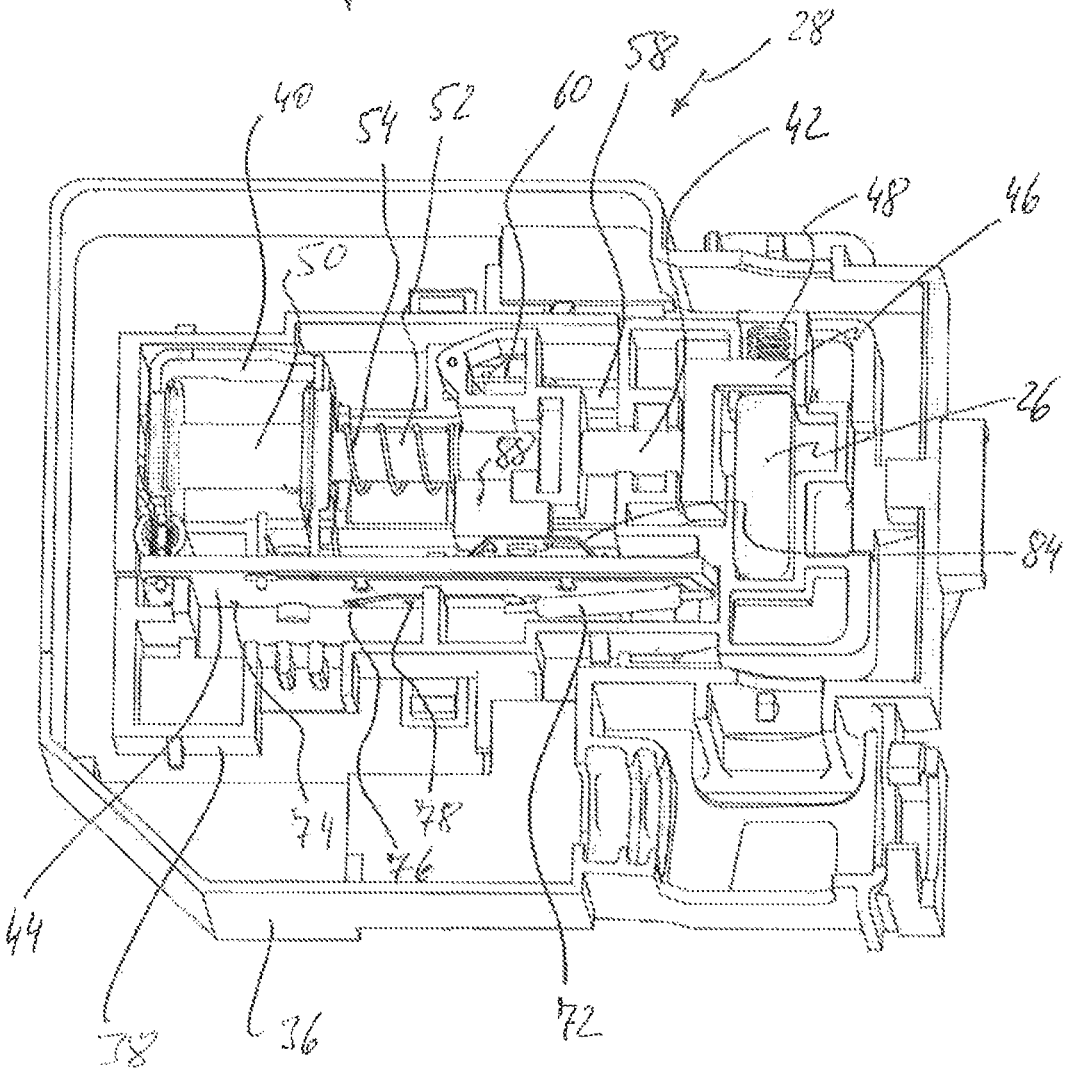
Figure 7A:
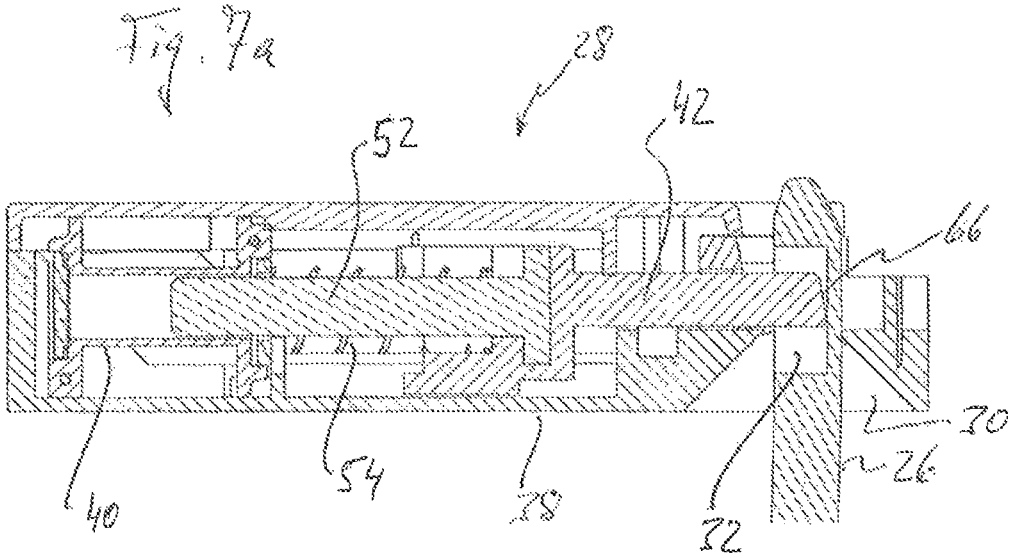
Figure 7B:
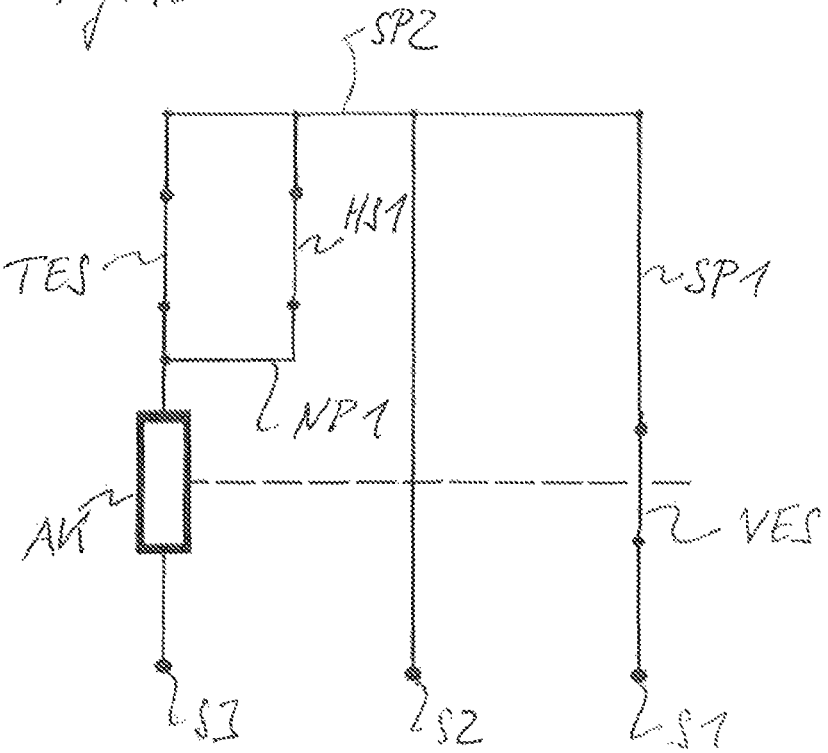

Closing the door detection switch TES enables the actuator AK to be energised. Its electrical activation leads to the forward movement of the locking slide 42 from the unlocking position into the locking position. In the locking position the locking slide 42 engages with its slide tip 66 in the blocking recess 32 of the closing element 26, wherein it is supported under the influence of the armature spring 54 on the bottom of the blocking recess 32. The abutment of the locking slide 42 on the bottom of the blocking recess 32 prevents further forward movement of the locking slide 42 beyond the locking position, FIG. 7*a* shows this situation.

In the course of the transfer of the locking slide 42 from the unlocking position into the locking position, both the auxiliary switch HS1 and the lock detection switch VES are closed. This electrical state of the lock assembly 28 is depicted in FIG. 7*b*. The switching points of the auxiliary switch HS1 and the lock detection switch VES or movement of the locking slide 42 from the unlocking position into the locking position can coincide or can be different. The closing of the lock detection switch VES can be a trigger for the start of a program cycle of the washing machine 10.

The distance expressed by the measurement d between the locking permit position and the switch closing position means that the lid 18 has a certain movement play in the locked state. Without anything changing in the locked state of the lid 18, the lid 18 can be lifted slightly by the user (intentionally or unintentionally) before the locking slide 42 hits the front boundary edge 80 from inside the blocking recess 32. This situation is depicted in FIG. 8*a*. Vibrations such as can occur during a spin cycle of the washing machine 10, for example, may also lead to shaking movements on the lid 18. In the case of such influences on the lid 18, it can occur that the door detection switch TES opens, as shown in FIG. 8*b*. Under the influence of vibrations in particular, it can occur that the door detection switch TES opens and closes again not just once, but repeatedly within a short time. Nothing changes regarding the closed state of the lid 18, however, in spite of such play movements. For this reason both the auxiliary switch HS1 and the lock detection switch VES remain in their closed switching state. The opening of the door detection switch TES therefore remains without influence on the control of the washing machine 10. The closed shunt path NP1 causes an electrical short-circuit of the door detection switch TES; nothing changes electrically at the connection points S2, S3 due to the temporary opening of the door detection switch TES. The control unit of the washing machine 10 does not even notice the temporary opening of the door detection switch TES, therefore. If the lid 18 is unlocked again, thus the locking slide 42 moves from the locking position back into the unlocking position, the auxiliary switch HS1 and the lock detection switch VES open again.

It cannot be excluded that a user tries to open the locked lid 18 forcibly. In this case it can happen that a part of the locking slide 42 breaks off and the user succeeds hereby in opening the lid 18. This situation is shown in FIG. 9. There an end piece of the locking slide 42 comprising the slide tip 66 has broken off and is lifted together with the closing element 26 out of the insertion mouth 30. In certain embodiments the locking slide 42 can be provided with a predetermined breaking point so that in the event of an attempt to open the locked lid 18 forcibly, a defined break situation occurs and the locking slide 42 does not break in an uncontrolled manner.

By removing the dosing element 26 from the insertion mouth 30, the support of the locking slide 42 on the bottom of the blocking recess 32 ceases. The locking slide 42 is therefore free for a further movement away from the unlocking position beyond the locking position. Due to further easing of the armature spring 50 the locking slide 42 is therefore pushed into a fault position shown in FIG. 9*b*. In the fault position, the main piece of the locking slide 42 connected to the break point protrudes into the insertion mouth 30 in such a way that the closing element 26 can no longer be fully inserted into the insertion mouth 30. The lid 18 can therefore no longer be closed. The fault position can be defined by the locking slide 42 or the magnet armature 52 hitting a stop face 82 (FIG. 9*a*), which is formed by the internal housing 38 or a stop structure arranged in a stationary manner relative to the internal housing 38.

As a consequence of the (forcible) opening of the lid 18, the door detection switch TES opens in the fault situation according to FIG. 9*a*. In this fault situation it should not be possible either to begin or continue a program cycle of the washing machine. In the exemplary embodiment shown, the lock detection switch VES therefore also opens upon transfer of the locking slide 42 to the fault position according to FIG. 9*b*.

Due to the transfer of the locking slide 42 to the fault position, moreover, the auxiliary switch HS1 opens; this situation is depicted in FIG. 9*c*. Alternatively it is conceivable that the auxiliary switch HS1 remains closed on transfer of the locking slide 42 to the fault position. In the case of a break in the locking slide 42 (as a result of the influence of force on the lid 18), it can be advantageous if the auxiliary switch HS1 is open in the fault position of the locking slide 42 and the circuit path SP2 is open accordingly. Energisation of the actuator AK is then no longer possible and a repair must first be undertaken before the washing machine 10 can be set in operation again. It cannot be excluded, however, that the locking slide 42 can get to the fault position according to FIG. 9*b* without destruction. In such a case the mechanical components of the lock assembly 28 continue to remain functional. If the auxiliary switch HS1 remains closed upon transfer of the locking slide 42 to the fault position, it is then possible to return the locking slide 42 to its unlocking position by activation of the actuator AK. This makes it possible to close the lid 18 properly again and to operate the washing machine 10 properly again.

In certain embodiments it can therefore be provided that the auxiliary switch HS1 is open in the fault position of the locking slide 42. In other embodiments it can be provided, on the other hand, that the auxiliary switch HS1 is closed in the fault position of the locking slide 42.

The fault position of the locking slide 42 according to FIG. 9*b* corresponds to position P5 of the track follower 60 within the track extension 70 of the guide track 58. Since the locking slide 42 is blocked in the fault position against further forward movement by stopping on the stop face 82, position P5 forms a further (third) non-transitory track position. The track follower 60 stays in position P5 until the locking slide 42 is moved back into the unlocking position corresponding to position P1 due to renewed actuation of the electromagnetic actuator 40.

Once the lid 18 has been closed, mechanical vibrations can lead to a temporary opening of the door detection switch TES. This applies in particular if the door detection switch TES is comparatively vibration-sensitive, as can occasionally be observed with reed switches. It has turned out that in a locking process, i.e. when the electromagnetic actuator 40 is activated to transfer the locking slide 42 from the unlocking position to the locking position, vibrations can occur as a result of the pulsed activation of the electromagnetic actuator 40 that can be sufficient to inadvertently open a closed reed switch. To avoid such vibration-induced switching processes of the door detection switch TES leading to malfunctions of the control unit of the washing machine 10 on locking of the lid 18, it is provided in certain embodiments that a shunt path to the door detection switch TES is closed depending on the fact that the locking slide 42 moves from the unlocking position according to FIG. 3*a* into a position corresponding to the intermediate position P2 of the track follower 60 (to the left in the depiction of FIG. 3*a*). Reference is now made in this respect to the circuit diagram according to FIG. 10.

In the configuration according to FIG. 10, another shunt path NP2 is provided, which runs parallel to the shunt path NP1. Arranged in the shunt path NP2 is another auxiliary switch HS2, the closure of which can short-circuit the door detection switch TES. The two auxiliary switches HS1, HS2 have different switching points. The switching point of auxiliary switch HS1 lies, as explained previously, at a point along the movement path of the locking slide 42 from the unlocking position into the locking position. The switching point of the auxiliary switch HS2, on the other hand, lies at a point along the movement path of the locking slide 42 from the unlocking position into the intermediate position (located opposite to the locking position), which corresponds to the intermediate position P2 of the track follower 60. In a locking process, the auxiliary switch HS2 initially closes, therefore (when the locking slide 42 moves to the left in FIG. 3*a* due to the magnetic force generated), then the auxiliary switch HS2 opens again (when the locking slide 42 in FIG. 3*a* moves to the right back towards the unlocking position) and after that the auxiliary switch HS1 closes (when the locking slide 42 moves from the unlocking position towards the locking position).

The explained electrical behaviour of the circuit according to FIG. 10 can be realised alternatively by a single shunt path to the door detection switch TES and a single auxiliary switch (e.g. the auxiliary switch HS1) if this single auxiliary switch is controlled accordingly.

Reference is made again to FIGS. 3*a*, 3*b*. Coupled to the locking slide 42 is a sliding lamella metal sheet 84, i.e. a component formed of electrically conductive sheet material, which in the example shown forms several sliding lamellae 86, which slide on the printed circuit board 44 on movement of the locking slide 42. The sliding lamella metal sheet 84 is attached to a lamella carrier 88, which is connected to the locking slide 42. Depending on the position of the sliding lamella metal sheet 84 relative to the printed circuit board 44, the lock detection switch VES and the auxiliary switch HS1 (or in the exemplary embodiment of FIG. 10 the auxiliary switches HS1 and HS2) are closed and opened. To this end an arrangement of conductor paths is formed on the printed circuit board 44, which are connected to one another or not by the sliding lamella metal sheet 84 depending on its position. For greater clarity, reference is made in this regard to FIGS. 11*a* to 11*d*, which show an exemplary configuration of the printed circuit board 44 that is suitable for the circuit design of FIG. 10 with two auxiliary switches HS1, HS2.

Figure 11B:
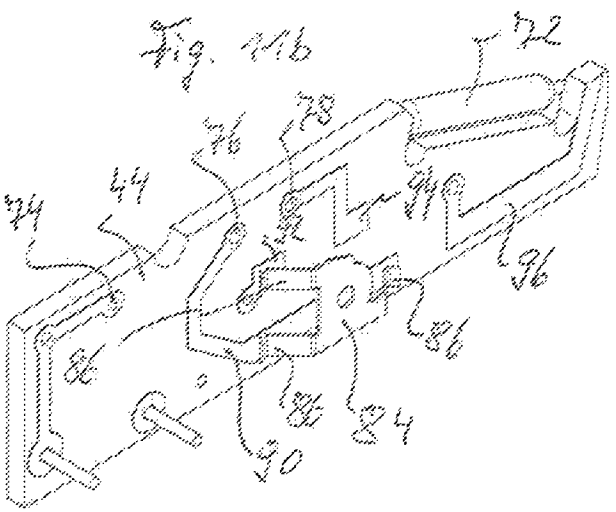
Figure 11D:
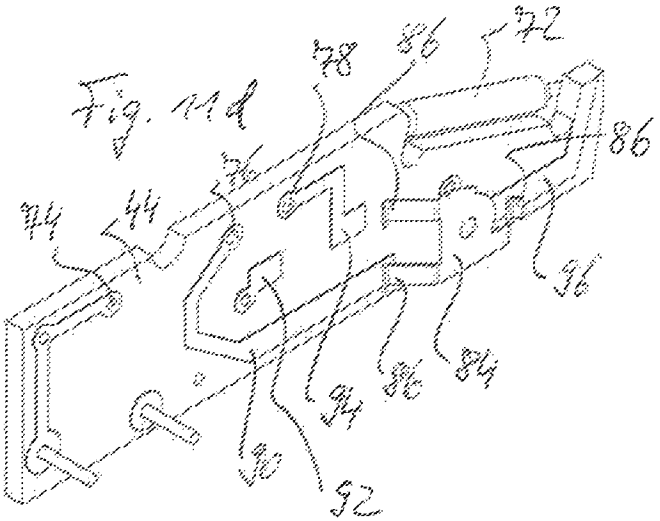
Figure 11A:
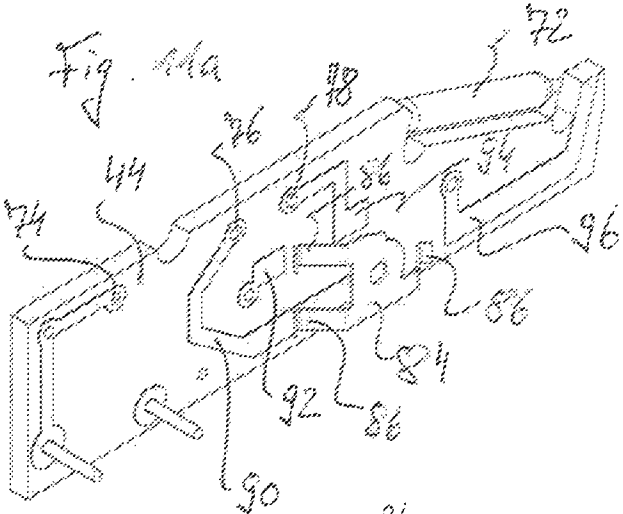

FIG. 11*a* corresponds to the unlocking position of the locking slide 42.

FIG. 11*b* corresponds to the intermediate position of the locking slide 42, which the locking slide 42 assumes when the track follower 60 is located in the intermediate position P2. In this situation two conductor path portions 90, 92 are connected electrically to one another by the sliding lamella metal sheet 84, corresponding to the closed switching state of the auxiliary switch HS2.

Figure 11C:
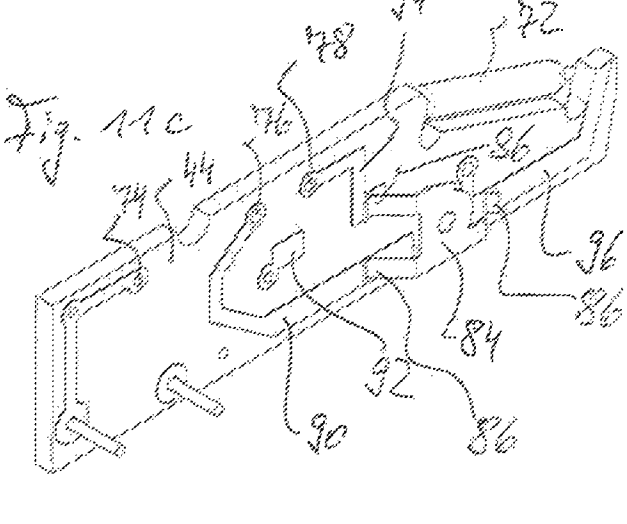

FIG. 11*c* corresponds to the locking position of the locking slide 42. In this situation the electrical connection between the conductor path portions 90, 92 is separated again; the auxiliary switch HS2 is accordingly open again. On the other hand, the conductor path portion 90 is now connected electrically by the sliding lamella metal sheet 84 to a conductor path portion 94, which corresponds to the closed switching state of the lock detection switch VES. Furthermore, the conductor path portion 90 is electrically connected by the sliding lamella metal sheet 84 to a conductor path portion 96, which corresponds to the closed switching state of the auxiliary switch HS1.

FIG. 11*d* corresponds to the fault position of the locking slide according to FIG. 9*b*. In this situation the sliding lamella metal sheet 84 no longer creates an electrical connection between the conductor path portions 90, 94. The lock detection switch VES is accordingly open. The electrical connection between the conductor path portions 90, 96 via the sliding lamella metal sheet 84 continues to exist, however, i.e. the auxiliary switch HS1 remains closed.

Reference is now made to the variant according to FIG. 4. Here the same components or components having the same effect are provided with the same reference characters as in the other figures, but with a small letter added. Unless stated otherwise below, reference is made to the above implementations with regard to such identical components or components with an identical effect. Instead of a magnetically actuatable door detection switch, the exemplary embodiment according to FIG. 4 uses a mechanically actuatable door detection switch 98*a* with the same electrical function as the reed switch 72 of the exemplary embodiment in FIGS. 3*a*, 3*b*. The mechanical door detection switch 98*a* is controlled mechanically by the auxiliary slide 46*a*. For this purpose the auxiliary slide 46*a* has a slide extension 100*a*, which interacts with a leaf spring 102*a*. When the lid of the washing machine is open (the depiction in FIG. 4 assumes this situation), the auxiliary slide 46*a* presses the leaf spring 102*a* away from the printed circuit board 44*a* by means of its slide extension 100*a*. An electrical switching contact 104*a* of the door detection switch 98*a* that is arranged on the leaf spring 102*a* is thereby out of contact with the printed circuit board 44*a*. This corresponds to an electrically open switching state of the door detection switch 98*a*. On dosing the lid, the auxiliary slide 463 is pressed upwards in FIG. 4. The slide extension 100*a* also moves upwards hereby, so that the switching contact 104*a* comes into contact with the printed circuit board 44*a*; the door detection switch 98*a* is thus closed.

Both the reed switch 72 in FIGS. 3*a*, 3*b* and the mechanical door detection switch 983 in FIG. 4 have no or at any rate no notable switching hysteresis in the exemplary embodiments considered here, i.e. they have corresponding switch-on and switch-off points. It is conceivable in other embodiments, however, to use a switch with switching hysteresis for the door detection switch TES. Such a switch has offset switch-on and switch-off points, to be precise in the manner that upon closing of the lid 18, the door detection switch TES closes at the switch closing position of the lid 18 explained further above, but on opening of the lid 18, the door detection switch TES reopens at another lid position (switch opening position), which is offset from the switch closing position towards the locking permit position. If upon opening of the lid 18 the door detection switch TES only opens when the lid 18 has moved into the vicinity of the locking permit position, up to the locking permit position or even beyond the locking permit position, for example, play movements of the locked lid 18 may then no longer lead to temporary opening of the door detection switch TES. The use of a switch with hysteresis for the door detection switch TES can therefore render the use of an auxiliary switch, which is arranged in the shunt to the door detection switch TES and closes on transfer of the locking slide 42 to the locking position, dispensable.

The invention claimed is:

1. A door lock for a domestic electrical appliance, comprising:

a movably arranged locking member selectively adjustable into an unlocking position and a locking position, wherein, in the unlocking position, the locking member permits the opening of a closed door of the household appliance and, in the locking position, is in blocking engagement with a blockable component at least when the door is closed, the blocking engagement causing the closed door to be blocked against opening;

an electrically controllable actuator for actuating the locking member;

an electrical door detection switch that switches depending on the closing of the door;

an electrical auxiliary switch device which selectively opens or closes an electrical shunt path to the electrical door detection switch depending on the position of the locking member; and an electrical lock detection switch which switches in dependence on a transfer of the locking member from the unlocking position into the locking position, wherein the electrical lock detection switch is arranged in a first circuit path extending between a first and a second electrical connection point of the door lock, wherein the electrically controllable actuator, the door detection switch and the auxiliary switch device are arranged in a second circuit path extending between the second electrical connection point and a third electrical connection point of the door lock, and wherein the auxiliary switch device closes a first electrical shunt path to the door detection switch when the locking member moves from the unlocking position towards the locking position and closes a second electrical shunt path to the door detection switch when the locking member moves from the unlocking position towards an intermediate position opposite the locking position.

2. The door lock according to claim 1, wherein the auxiliary switch device closes an electrical shunt path to the electrical door detection switch when the locking member moves from the unlocking position towards the locking position.

3. The door lock according to claim 2, wherein the locking member is arranged for movement from the unlocking position into the locking position and beyond the locking position into a fault position and wherein the auxiliary switch device either opens the shunt path or keeps it closed when the locking member moves from the locking position towards the fault position.

4. The door lock according to claim 1 wherein the auxiliary switch device closes the electrical shunt path to the door detection switch when the locking member moves from the unlocking position towards an intermediate position opposite to the locking position.

5. The door lock according to claim 1, wherein the blockable component includes a blocking edge which, on closing the door, moves past the locking member into and beyond a locking permit position, the locking permit position being a position from which the locking member can be moved in front of the blocking edge to thereby block the door against reverse movement, and wherein the door detection switch, on closing the door, only changes its electrical switching state when the blocking edge has moved beyond the locking permit position.

6. The door lock according to claim 1, wherein the door detection switch is a magnetically or mechanically operated switch without switching hysteresis.

7. The door lock according to claim 1, wherein the blockable component includes a blocking edge which, on closing the door, moves past the locking member into and beyond a locking permit position, the locking permit position being a position from which the locking member can be moved in front of the blocking edge to thereby block the door against reverse movement, wherein the door detection switch, on closing the door, only changes its electrical switching state when the blocking edge has moved beyond the locking permit position into a first switching position, and wherein the door detection switch, on opening the closed door, changes its electrical switching state into a second switching position of the blocking edge, which is offset from the first switching position towards the locking permit position.

8. The door lock according to claim 1, wherein the electrically controllable actuator is an electromagnetic actuator comprising a magnet armature arranged to be driven by magnetic excitation in a single drive direction only, that the locking member is motion-coupled to the magnet armature and is biased by spring force against the drive direction, and that the locking member is associated with a guide system for position control of the locking member, the guide system comprising a guide track closed in the manner of a loop and a track follower guided on the guide track, wherein the track follower performs a complete round trip along the guide track upon successive actuations of the electromagnetic actuator, wherein at each round trip the track follower moves from a first non-transitory track position corresponding to the unlocking position of the locking member into a second non-transitory track position corresponding to the locking position of the locking member and back again into the first non-transitory track position, wherein the locking member is arranged for movement from the unlocking position to the locking position and beyond the locking position into a fault position, and wherein the guide path provides an escape space which allows the track follower to retreat from the second non-transitory track position to a third non-transitory track position corresponding to the fault position of the locking member.

9. The door lock according to claim 1, further comprising an auxiliary member which is separate from the blockable component and is arranged for movement from a release position to a blocking position depending on the closing of the door, which, in the release position, allows the locking member to be transferred from the unlocking position to the locking position and, in the blocking position, blocks the locking member against transfer from the unlocking position to the locking position, wherein, on closing the door, the door detection switch undergoes an electrical switching state change under mechanical control by the auxiliary member.

10. A door lock for a domestic electrical appliance, comprising:

a movably arranged locking member selectively adjustable into an unlocking position and a locking position, wherein, in the unlocking position, the locking member permits the opening of a closed door of the household appliance and, in the locking position, is in blocking engagement with a blockable component at least when the door is closed, the blocking engagement causing the closed door to be blocked against opening;

an electrically controllable actuator for actuating the locking member;

an electrical door detection switch that switches depending on the closing of the door;

an electrical auxiliary switch device which selectively opens or closes an electrical shunt path to the electrical door detection switch depending on the position of the locking member; and an electrical lock detection switch which switches in dependence on a transfer of the locking member from the unlocking position into the locking position, wherein the electrical lock detection switch is arranged in a first circuit path extending between a first and a second electrical connection point of the door lock, wherein the electrically controllable actuator, the door detection switch and the auxiliary switch device are arranged in a second circuit path extending between the second electrical connection point and a third electrical connection point of the door lock, and wherein the auxiliary switch device is formed of a printed circuit board and a sliding lamella system which is movably coupled to the locking element and is in sliding contact with the printed circuit board.

11. A door lock for a domestic electrical appliance, comprising:

a movably arranged locking member selectively adjustable into an unlocking position and a locking position, wherein, in the unlocking position, the locking member permits the opening of a closed door of the household appliance and, in the locking position, is in blocking engagement with a blockable component at least when the door is closed, the blocking engagement causing the closed door to be blocked against opening;

an electrically controllable actuator for actuating the locking member;

an electrical door detection switch that switches depending on the closing of the door;

an electrical auxiliary switch device which selectively opens or closes an electrical shunt path to the electrical door detection switch depending on the position of the locking member; and an electrical lock detection switch which switches in dependence on a transfer of the locking member from the unlocking position into the locking position, wherein the electrical lock detection switch is arranged in a first circuit path extending between a first and a second electrical connection point of the door lock, wherein the electrically controllable actuator, the door detection switch and the auxiliary switch device are arranged in a second circuit path extending between the second electrical connection point and a third electrical connection point of the door lock, and wherein the locking member is arranged for movement from the unlocking position into the locking position and beyond the locking position into a fault position and wherein the lock detection switch switches back into a switching state corresponding to the unlocking position as a function of a transfer of the locking member from the locking position into the fault position.

* * * * *